US012330042B1

(12) United States Patent
Valdes

(10) Patent No.: US 12,330,042 B1
(45) Date of Patent: Jun. 17, 2025

(54) MOBILE FITNESS TRAINING AND TESTING DEVICE

(71) Applicant: Sergio Valdes, Brandon, FL (US)

(72) Inventor: Sergio Valdes, Brandon, FL (US)

(73) Assignee: Hoplites Military Solutions LLC, Brandon, FL (US)

( * ) Notice: Subject to any disclaimer, the term of this patent is extended or adjusted under 35 U.S.C. 154(b) by 712 days.

(21) Appl. No.: 17/650,335

(22) Filed: Feb. 8, 2022

Related U.S. Application Data

(60) Provisional application No. 63/147,025, filed on Feb. 8, 2021.

(51) Int. Cl.

| | |
|---|---|
| ***A63B 71/02*** | (2006.01) |
| ***A63B 6/00*** | (2006.01) |
| ***E01C 13/00*** | (2006.01) |
| ***E01C 13/08*** | (2006.01) |

(52) U.S. Cl.
CPC ..... *A63B 71/03* (2020.08); *A63B 6/00* (2013.01); *E01C 13/08* (2013.01); *A63B 2071/024* (2013.01); *A63B 2210/50* (2013.01); *E01C 2013/006* (2013.01)

(58) Field of Classification Search
CPC ... A63B 6/00; A63B 21/4037; A63B 71/0054; A63B 71/02; A63B 71/023; A63B 71/03; A63B 71/04; A63B 2071/0063; A63B 2071/024; A63B 2071/026; A63B 2071/027; A63B 2071/0694; A63B 2209/00; A63B 2210/00; A63B 2210/50; A63B 2225/09; E01C 13/08; E01C 2013/006
See application file for complete search history.

(56) References Cited

U.S. PATENT DOCUMENTS

| | | | | |
|---|---|---|---|---|
| 4,988,106 | A * | 1/1991 | Coonrod | A63B 69/3661 473/162 |
| 7,155,796 | B2 | 1/2007 | Cook | |
| 7,249,913 | B2 | 7/2007 | Linville | |
| 7,273,642 | B2 | 9/2007 | Prevost | |
| 9,278,243 | B1 | 3/2016 | Heartsfield et al. | |
| 9,464,388 | B1 | 10/2016 | Sternberg et al. | |
| 2012/0227181 | A1* | 9/2012 | Cintas | A47G 27/0237 112/475.08 |
| 2015/0297966 | A1* | 10/2015 | Tyndall | A63B 71/02 473/497 |

(Continued)

FOREIGN PATENT DOCUMENTS

| | | | | |
|---|---|---|---|---|
| CA | 2928211 | A1 | 10/2016 | |
| DE | 102012108426 | B3 * | 2/2014 | A63B 6/00 |

(Continued)

*Primary Examiner* — Gary D Urbiel Goldner
(74) *Attorney, Agent, or Firm* — Owen G. Behrens; Smith & Hopen, P.A.

(57) ABSTRACT

A mobile fitness training and testing device (MFD) may permit a rapid deployment of an exercise area The MFD may include a lane that is temporarily encapsulated within a containment unit during storage. During use, a team of users may grasp at least one handle of the containment unit and transport the MFD to a desired training location. The lane may be secured to a surface via a plurality of anchors. One or more lanes may be coupled vertically and/or horizontally to increase a size of the testing environment.

20 Claims, 17 Drawing Sheets

(56) References Cited

U.S. PATENT DOCUMENTS

| | | | | |
|---|---|---|---|---|
| 2016/0151694 | A1* | 6/2016 | Tyndall | A63B 69/0013 473/451 |
| 2016/0312414 | A1 | 10/2016 | Fowler et al. | |
| 2017/0156479 | A1* | 6/2017 | Kwong | A45F 4/02 |
| 2018/0056166 | A1* | 3/2018 | Bross | A63B 71/0036 |
| 2018/0257832 | A1* | 9/2018 | Loeffler | A45C 3/00 |
| 2018/0326253 | A1* | 11/2018 | DeRaimo | A63B 21/4037 |
| 2019/0099654 | A1* | 4/2019 | Sobalvarro | A63B 21/4037 |
| 2019/0126121 | A1* | 5/2019 | Ramaswamy | A63B 71/0036 |
| 2020/0179747 | A1* | 6/2020 | Chhabra | A47K 10/02 |
| 2020/0215379 | A1* | 7/2020 | Stryska | A63B 21/4037 |
| 2020/0215422 | A1* | 7/2020 | Kerr | A63C 19/12 |
| 2021/0205679 | A1* | 7/2021 | Moody, Jr. | A63B 55/406 |
| 2021/0236899 | A1* | 8/2021 | Badman | A63B 69/0002 |
| 2021/0244991 | A1* | 8/2021 | Pickett | H01F 7/0252 |

FOREIGN PATENT DOCUMENTS

| | | | | |
|---|---|---|---|---|
| FR | 3118688 | A1 * | 7/2022 | |
| KR | 102257316 | B1 * | 5/2021 | A63B 69/36 |
| KR | 102365463 | B1 * | 2/2022 | A63B 6/02 |

* cited by examiner

MOBILE FITNESS TRAINING AND TESTING DEVICE

CROSS-REFERENCE TO RELATED APPLICATIONS

This nonprovisional application claims the benefit of U.S. Provisional Application No. 63/147,025 entitled "MOBILE FITNESS TRAINING AND TESTING DEVICE," filed Feb. 8, 2021 by the same inventor, which is incorporated herein by reference in its entirety.

BACKGROUND OF THE INVENTION

1. Field of the Invention

This invention relates, generally, to fitness and training equipment. More specifically, it relates to a device, system and method for rapidly deploying a portable fitness training and testing device for individual users, athletes, law enforcement, and the military.

2. Brief Description of the Prior Art

The United States Army utilizes the Army Combat Fitness Test (ACFT) to test the combat readiness of Army soldiers. The ACFT consists of a series of fitness testing events, including the 3 Repetition Maximum Deadlift (MDL), Standing Power Throw (SPT), Hand Release Push-Up-Arm Extension (HRP), Sprint-Drag-Carry (SDC), Leg Tuck (LTK), and Two-Mile Run (2MR). Of particular importance is the SDC test. The SDC test is a qualifying event that evaluates the strength, endurance, and anaerobic capacity of our soldiers. The SDC is critical to evaluating the soldier's ability to accomplish high-intensity combat tasks of varying lengths.

The SDC test is conducted in a lane. During testing, the soldier performs various sprints, dragging, lateral, and carry events in rapid succession within the same lane. However, as the SDC test is repeatedly conducted for one soldier after another, the lane becomes worn out. This deterioration results in nonuniform testing between soldiers. Furthermore, as the lane becomes more and more worn down, there is a significant increase in the risk of soldier injury.

Moreover, such risks are compounded when the SDC test is performed on a grass surface. Specifically, after each pass by the soldiers, the grass becomes more compacted, resulting in a slicker testing environment. Accordingly, testing environments become prone to nonuniformity between tests. As a result, the traditional grass surface fails to provide a uniform surface per test resulting in significant variances between soldiers. Furthermore, compacted grass surfaces fail to provide soldiers with a safe or time-efficient environment for testing and training events. In particular, when time is of the essence, such as during combat readiness testing, soldiers often times push their bodies to the limits. This increased effort on the part of the soldier often leads to soldiers slipping on the compact grass surface, causing serious injuries. When time is of the essence, the soldiers push their bodies to the limits, often slipping on the compacted grass surface, causing serious injuries.

Additionally, the SDC test, along with other ACFT exercises, are routinely performed in a wide variety of environments. For example, one week a soldier could be training in Washington, D.C., and then next be deployed overseas. As you can imagine, such variances between terrains in the environments can not only increase the risk of injury to the soldier but inherently provide inaccuracies. Specifically, different terrains will allow soldiers of the same fitness levels (or even the same soldier themselves) to have wide variances in their performance. Because the SDC event, like other ACFT events, aims to establish a consistent baseline for soldier readiness, such terrain changes are problematic. When the terrain, environment, and/or field changes based on where the test or event is being performed, there inherently lacks consistency between tests, thereby reducing the overall accuracy and effectiveness of the ACFT events.

Prior art U.S. Pat. No. 7,249,913 B2, issued Jul. 31, 2007, to Linville illustrates a filled artificial turf having a plurality of filled sections. The sections include hook and loop fasteners to couple the filled sections to one another. However, the artificial turf taught by the Linville disclosure has significant drawbacks. For example, the Linville disclosure is stored filled, which substantially increases the weight of the turf rolls and therefore requires heavy machinery or equipment to transport the turf. In fact, the Linville references specifically require "a team of laborers" to remove the deployed turf. Thus, the turf sections of the Linville reference are not quickly deployable or transportable in a wide range of environments.

A modular sports field is discussed in U.S. Pat. No. 7,155,796 B2, issued Jan. 2, 2007 to Cook, which illustrates a modular synthetic grass surface. Again, like the Linville reference, the prior art is not easily portable. Specifically, "the installation of each modular unit is accomplished by using forklifts or other suitable equipment to move the modular units to the desired location." This is a significant drawback, especially for soldiers deployed to remote areas where access to heavy machinery is limited.

Accordingly, what is needed is a safe, portable, and easy to use mobile fitness training and testing device that establishes a baseline measurement regardless of where a user is located. Thus, each user receives the same consistent and safe test to determine and evaluate the user's fitness and combat readiness. However, in view of the art considered as a whole at the time the present invention was made, it was not obvious to those of ordinary skill in the field of this invention how the shortcomings of the prior art could be overcome.

All referenced publications are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The present disclosure provides an apparatus, system, and method of use of a mobile fitness training and testing device (MFD) designed to be rapidly deployable in various environments to provide consistent and safe testing, including, but not limited to, being deployed with just two users.

In an aspect, the present disclosure provides a mobile fitness training and testing device comprising. The device includes a lane having an elongated body extending between a first end and a second end and a width extending between a first lateral side and a second lateral side. A perimeter outlines the elongated body and the width of the lane.

The training device further includes a turf layer with a height extending between a top surface and a bottom surface of the turf layer. An underlying substrate resides below the turf layer and includes a height extending between a top surface and a bottom surface with the bottom surface of the turf layer adhered to the top surface of the underlying substrate. In some embodiments, the height of the underlying substrate comprises a range of at least 0.1 inches and at most 2 inches. In some embodiments of the height of the turf layer comprises a range of at least 0.1 inches and at most 4 inches. In some embodiments, the underlying substrate comprises one layer, and a shock-resistant material, such as a rubber material. In some embodiments, the underlying substrate comprises two separate layers, a shock-absorbent layer and a grip layer.

Some embodiments include a plurality of apertures disposed about at least a portion of the perimeter. Each of the plurality of apertures extends from the top surface of the turf layer through the bottom surface of the underlying substrate. In some embodiments, a plurality of anchors are also provided. The plurality of anchors, such as a stake apparatus, is configured to operably engaged to the plurality of apertures.

In some embodiments, the lane is configured to interconnect to at least one alternative lane. In addition, the lane includes at least two configurations, including an extended configuration and a compact configuration. The extended configuration comprises the lane unfurled and disposed adjacent to a surface in a planar configuration. The compact configuration, such as a coiled configuration, a folded configuration, and a collapsed configuration, comprises the lane adapted to fit within a containment unit. In some embodiments, the elongated body of the lane comprises a distance of at least 10 meters to at most 30 meters, and the width comprises a distance of at least 0.5 meters to at most 5 meters. In addition, the lane is configured to interconnect to at least one alternative lane through a connection apparatus.

In some embodiments, the containment unit comprises a body having an interior surface opposite an exterior surface. The interior surface of the body is configured to abut at least a portion of the lane when the lane is encapsulated within the containment unit. The containment unit further includes a strap. The strap is coupled to at least a portion of the exterior surface of the body and has a body extending between a first end and a second end, and a handle is disposed on a portion of the body of the strap. In some embodiments, the first end and the second end of the strap includes an attachment component. The attachment component is configured to engage the first end and the second end of the strap thereby securing the interior surface of the body around the lane.

In some embodiments, the turf layer comprises a plurality of fibers and a backing material. The plurality of fibers is attached to the backing material. In some embodiments, the turf layer comprises labeled calibrated distance markings along at least one of the lateral sides of the lane. The turf layer also comprises a line marking along at least one of the ends of the lane.

In some embodiments, at least the first end, the second end, the first lateral side, or the second lateral side is coupled with an end cap. The end cap comprises wear resistant material that includes a gradually sloped body spaced between the surface and the lane.

In another aspect, the present invention includes a mobile fitness training and testing device having a lane. The lane comprises an elongated body extending between a first end and a second end, and a width extending between a first lateral side and a second lateral side. The elongated body comprises a distance of at least 10 meters to at most 30 meters, and the width comprises a distance of at least 0.5 meters to at most 5 meters.

In some embodiments, a perimeter outlines the elongated body and the width of the lane, and the lane comprises a turf layer that includes a height extending between a top surface and a bottom surface. The height of the turf layer comprises a range of at least 0.1 inches and at most 4 inches. The lane comprises an underlying substrate, where the underlying substrate includes a height extending between a top surface and a bottom surface. The height of the underlying substrate comprises a range of at least 0.1 inches and at most 2 inches, and the bottom surface of the turf layer is adhered to the top surface of the underlying substrate. In some embodiments, the lane comprises a plurality of apertures disposed about at least a portion of the perimeter. In addition, a plurality of anchors, such as a stake apparatus, is operably engaged with the plurality of apertures.

In some embodiments, the mobile fitness training and testing device comprises a containment unit that comprises a body having an interior surface opposite an exterior surface. The interior surface of the body is configured to abut at least a portion of the lane, when the lane is encapsulated within the containment unit. In some embodiments, a strap is coupled to at least a portion of the exterior surface of the body, and the strap has a body extending between a first end and a second end. In addition, a handle is disposed on a portion of the body of the first strap and the second strap. The mobile fitness training and testing device comprises a weight of at most 275 lbs., as the lane is enclosed within the containment unit.

In another aspect, the present disclosure provides a method of training using a mobile fitness training and testing device comprising: (a) transporting a lane to a predetermined testing location; (b) removing the lane from a containment unit; (c) unfurling and disposing the lane adjacent to a surface in a substantially planar configuration; (d) anchoring the lane to the surface adjacent to the lane through a plurality of anchors, in which the plurality of anchors is operably engaged to the plurality of apertures disposed about the perimeter of the lane; and (e) performing activities upon the lane, where at least one user can exercise and execute tasks.

In some embodiments, the lane comprises an elongated body extending between a first end and a second end and a width extending between a first lateral side and a second lateral side, and a perimeter, in which the perimeter outlines the elongated body and the width of the lane. The lane comprises a turf layer, where the turf layer includes a top surface and a bottom surface, and an underlying substrate, where the underlying substrate includes a top surface and a bottom surface, in which the bottom surface of the turf layer is adhered to the top surface of the underlying substrate. In addition, the lane is configured to interconnect to at least one alternative lane and is adapted to fit within a containment unit. The lane is adapted to fit within the containment unit through techniques comprising coiling, folding, and collapsing.

In some embodiments, a plurality of apertures are disposed about at least a portion of the perimeter, in which the plurality of apertures extends from the top surface of the turf layer through the bottom surface of the underlying substrate. In addition, a plurality of anchors, such a stake apparatus, is operably engaged with the plurality of apertures.

In some embodiments, the containment unit comprises a body having an interior surface opposite an exterior surface, where the interior surface of the body configured to abut at least a portion of the lane, when the lane is positioned within the containment unit. The containment unit also comprises a strap, where the strap is coupled to at least a portion of the exterior surface of the body.

In some embodiments, the strap has a body extending between a first end and a second end. In some embodiments, the containment unit comprises a handle that is disposed on a portion of the body of the first strap and the second strap. In some embodiments, the first end and second end of the strap includes an attachment component. The attachment component is configured to engage the first end and the second end thereby securing the interior surface of the body around the lane.

Additional aspects and advantages of the present disclosure will become readily apparent to those skilled in this art from the following detailed description, wherein only illustrative embodiments of the present disclosure are shown and described. As will be realized, the present disclosure is capable of other and different embodiments, and its several details are capable of modifications in various obvious respects, all without departing from the disclosure. Accordingly, the drawings and description are to be regarded as illustrative in nature, and not restrictive.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

Figure 1:
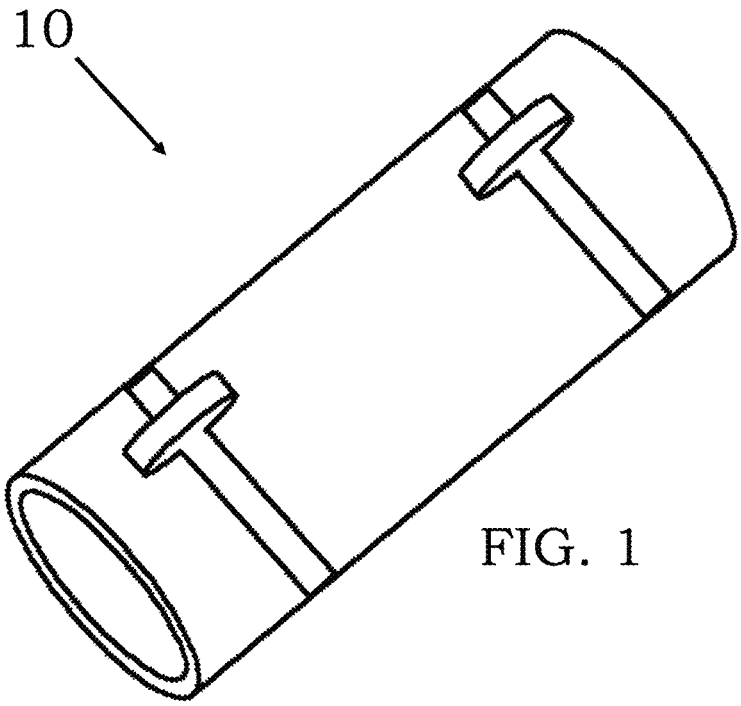
FIG. 1 is a perspective view of an embodiment of the mobile fitness training and testing device (MFD) according to embodiments of the present disclosure.

In the following detailed description of the preferred embodiments, reference is made to the accompanying drawings, which form a part thereof, and within which are shown by way of illustration specific embodiments by which the invention may be practiced. It is to be understood that one skilled in the art will recognize that other embodiments may be utilized, and it will be apparent to one skilled in the art that structural changes may be made without departing from the scope of the invention.

For purposes of explanation, specific details are set forth in order to provide an understanding of the disclosure. It will be apparent, however, to one skilled in the art that the disclosure can be practiced without these details. Furthermore, it is to be understood that one skilled in the art will recognize that embodiments of the present disclosure, described below, may be implemented in a variety of ways, such as, an apparatus, a system, or a device.

Elements/components shown in diagrams are illustrative of exemplary embodiments of the disclosure and are meant to avoid obscuring the disclosure. Reference in the specification to "one embodiment," "preferred embodiment," "an embodiment," or "embodiments" means that a particular feature, structure, characteristic, or function described in connection with the embodiment is included in at least one embodiment of the disclosure and may be in more than one embodiment. The appearances of the phrases "in one embodiment," "in an embodiment," "in embodiments," "in other embodiments" or "in some embodiments" in various places in the specification are not necessarily all referring to the same embodiment or embodiments. The terms "include," "including," "comprise," and "comprising" shall be understood to be open terms and any lists that follow are examples and not meant to be limited to the listed items.

Any headings used herein are for organizational purposes only and shall not be used to limit the scope of the description or the claims. Furthermore, the use of certain terms in various places in the specification of for illustration and should not be construed as limiting.

As used in this specification and the appended claims, whenever the term "at least," "greater than," or "greater than or equal to" precedes the first numerical value in a series of two or more numerical values, the term "at least," "greater than," or "greater than or equal to" applies to each of the numerical values in that series of numerical values. For example, greater than or equal to 1, 2, or 3 is equivalent to greater than or equal to 1, greater than or equal to 2, or greater than or equal to 3.

As used in this specification and the appended claims, whenever the term "no more than," "less than" or "less than or equal to" precedes the first numerical value in a series of two or more numerical values, the term "no more than," "less than," or "less than or equal to" applies to each of the numerical values in that series of numerical values. For example, less than or equal to 3, 2, or 1 is equivalent to less than or equal to 3, less than or equal to 2, or less than or equal to 1.

As used in this specification and the appended claims, the singular forms "a," "an," and "the" include plural referents unless the content clearly dictates otherwise. As used in this specification and the appended claims, the term "or" is generally employed in its sense including "and/or" unless the context clearly dictates otherwise.

As used in this specification and the appended claims, the use of the term "user," "users," and the like described herein may comprise soldiers, police officers, firefighters, athletes, gym members, or any person actively engaging with the device.

In embodiments, the present disclosure provides a mobile fitness training and testing device (MFD) designed to be rapidly deployable in various environments to provide consistent and safe testing. In embodiments, the present disclosure may provide a safe, uniform, and controlled testing and training environment for the armed forces, athletes, or users looking to exercise casually. In embodiments, of the present disclosure may be quickly deployed with just two users, without the need to rely on heavy machinery. In embodiments, the present disclosure may also be configured to serve as a decontamination mat or provide an anti-trip flooring when deployed.

Figure 2:
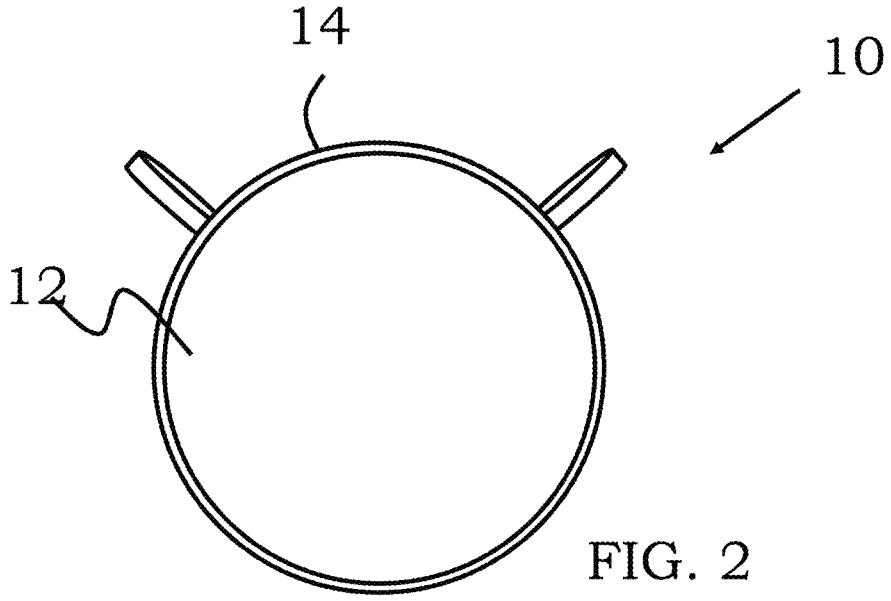
FIG. 2 is a side view of an embodiment of the MFD according to embodiments of the present disclosure.

FIGS. 1-4, depict MFD 10 comprising lane 12 and specially adapted containment unit 14, according to embodiments of the present disclosure. In embodiments, lane 12 may include two configurations, comprising an extended configuration and a compacted configuration. FIG. 1 and FIG. 2 depict MFD 10 in a compacted configuration, according to embodiments of the present disclosure. In embodiments, lane 12 may be configured into the compacted configuration to be stored within containment unit 14 to increase mobility and decrease MFD's 10 footprint during storage. In embodiments, lane 12 may be configured to be rolled-up (or coiled) and disposed within containment unit 14 in a substantially cylindrical configuration as shown in FIG. 1.

In other embodiments, as shown in FIG. 1, lane 12 may be configured to be folded or compressible and similarly encapsulated and enclosed within containment unit 14. When MFD 10 is ready to be deployed, lane 12 may be removed from containment unit 14 and put into the extended configuration. In embodiments, the extended configuration may comprise lane 12 completely unfurled and disposed adjacent to a substantially planar surface, that comprises wood or concrete flooring. In other embodiments, lane 12 may be disposed adjacent to a substantially planar surface, that comprises compact grass, sand, dirt, or any other surface known in the art.

Figure 3:
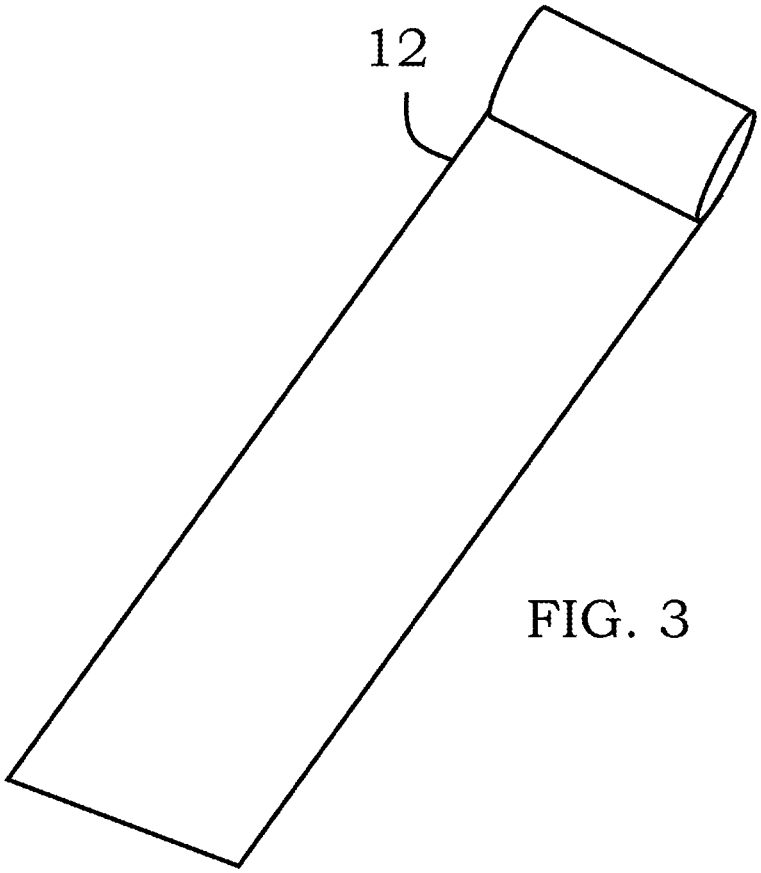
FIG. 3 is a perspective view of an embodiment of a lane in a partially unfurled state according to embodiments of the present disclosure.
Figure 4:
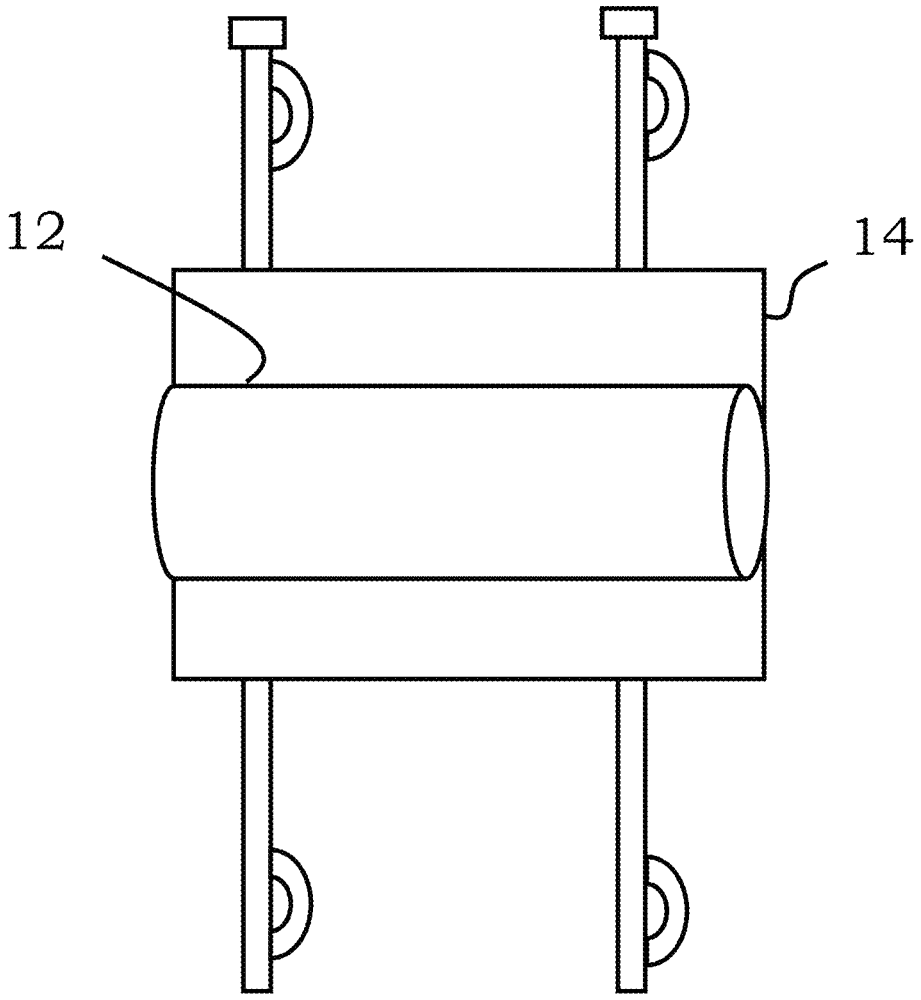
FIG. 4 is a top view of an embodiment of the lane disposed within an uncoupled containment unit according to embodiments of the present disclosure.

FIG. 3 depicts partially unfurled lane 12 as lane 12 transitions between the compact configuration to the extended configuration, according to embodiments of the present disclosure. In embodiments, lane 12 may be unfurled through techniques comprising unrolling, unfolding, or any other unfurling technique known in the art. FIG. 4 depicts containment unit 14 uncoupled from lane 12 in the compacted configuration, according to embodiments of the present disclosure. In embodiments, containment unit 14 may comprise a net, a duffle bag, or sack. In embodiments, containment unit 14 may be removed from an exercise area either before or after lane 12 is placed into the extended configuration. In embodiments, MFD 10 may comprise a total weight of at most 500 lbs., as lane 12 is coupled and encapsulated within containment unit 14. In some embodiments, MFD 10 may comprise a weight of at most 275 lbs. In some embodiments, MFD 10 may be configured to be carried by at most two users.

Lane Component

Figure 5:
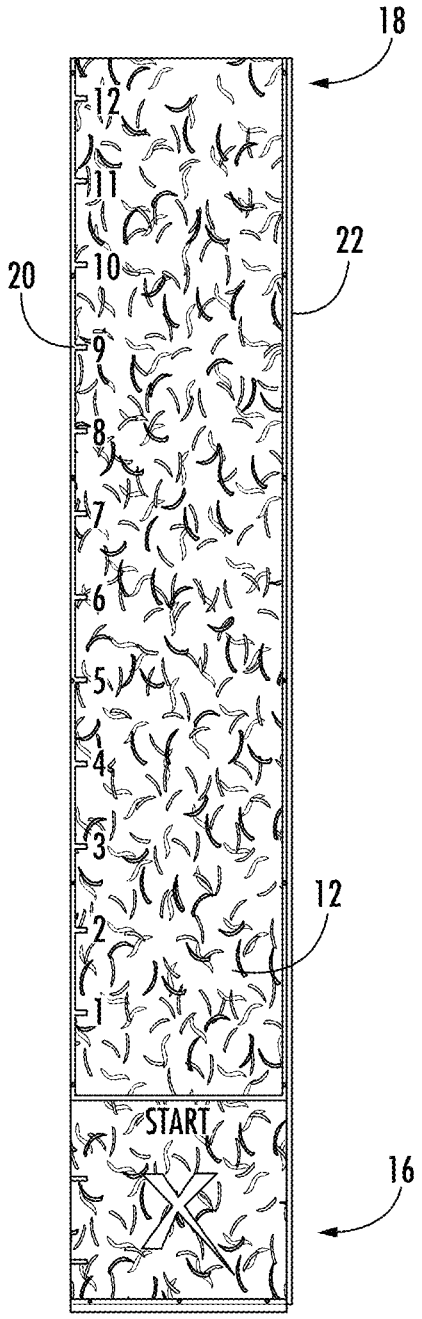
FIG. 5 is a top view of an embodiment of a lane according to embodiments of the present disclosure.
Figure 6:
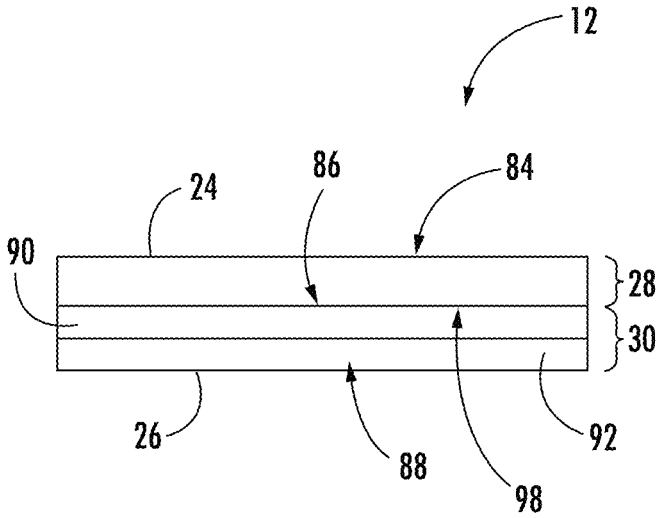
FIG. 6 is a side view of an embodiment of the lane of FIG. 5 according to embodiments of the present disclosure.

FIGS. 5 and 6 depict an embodiment of deployable, semi-permanent, and relatively rectangular and flat elongated lane 12, according to embodiments of the present disclosure. As depicted, lane 12 may include an elongated body extending between first end 16 and second end 18. In embodiments, the elongated body may be between 10 meters and 30 meters to accommodate multiple uses, such as ACFT events. In embodiments, first lateral side 20 and second lateral side 22 (collectively referred to as lateral sides 20, 22) establish a width therebetween. In embodiments, the width of lane 12 may comprise a range of at least 0.5 meters and at most 5 meters. Top surface 24 and bottom surface 26 establish a thickness of lane 12. In embodiments, the thickness of lane 12 may comprise a range of at least 0.2 inches and at most 6 inches. In some embodiments, the thickness of lane 12 may comprise 0.5 inches.

As shown in FIG. 6, in embodiments, lane 12 may be formed having a bi-layer construction, including turf layer 28 and underlying substrate 30. In embodiments, turf layer 28 may comprise a height extending between turf bottom surface 86 and turf top surface 84. In embodiments, underlying substrate 30 may comprise a height extending between underlying substrate bottom surface 88 and underlying substrate top surface 98. In some embodiments, the height of underlying substrate 30 may comprise 0.1 inches. In some embodiments, the height of underlying substrate 30 may comprise a range of at least 0.1 inches and at most 2 inches. In embodiments, turf layer 28 may comprise an artificial or synthetic turf, however, in other embodiments, turf layer 28 may include various surfaces that are configured to provide a safe, durable, and consistent testing and exercise surface. In embodiments, the artificial turf of turf layer 28 may comprise a plurality of fibers and a backing material. In some embodiments, the height of turf layer 28 may comprise 0.5 inches. In some embodiments, the height of turf layer 28 may comprise a range of at least 0.1 inches and at most 4 inches. In embodiments, the plurality of fibers may attach to the backing material. In embodiments, underlying substrate 30 may be disposed opposite of turf layer 28. In embodiments, underlying substrate 30 may be configured to reside adjacent to the ground when lane 12 is deployed.

As shown in FIG. 6, in embodiments, underlying substrate 30 may prevent slippage or unintended movement of lane 12 with respect to the ground when the users are using lane 12. In embodiments, underlying substrate 30 may be constructed with a shock-resistant component or material configured to cushion the user's impact and reduce the risk of injury, particularly to the knees. In embodiments, lane 12 may include the impact material impregnated within underlying substrate 30. In other embodiments, underlying substrate 30 may comprise at least one layer. Underlying substrate 30 may comprise multiple layers including individual impact layers, a cushion layers, and slippage layers. In embodiments, the impact material impregnated within underlying substrate 30 may comprise the shock-resistant material. In embodiments, the shock-resistant material may comprise a rubber material, a polyethylene material, or any other shock-resistant material known in the art.

As shown in FIG. 5, in embodiments, turf layer 28 may include labeled calibrated distance markings, thereon, along at least one of lateral sides 20, 22. In embodiments, turf layer 28 may include a line marking, thereon, along at least one of lane 12 ends, first end 16 or second end 18. In embodiments, the markings on turf layer 28 may be distanced based on yards, meters, inches, or any calibrated distance, or any other distance known in the art for the activity being performed on lane 12.

As shown in FIG. 6, underlying substrate 30 may comprise two layers, shock-absorbent layer 90, and grip layer 92. In some embodiments, the coefficient of friction of underlying substrate 30 may be greater than the coefficient of friction of turf layer 28. Accordingly, grip layer 92 may have a coefficient of friction sufficient to restrain lane 12 as it is unfurled. In some embodiments, shock-absorbent layer 90 may comprise of a latex, rubber, neoprene, silicone, sorbothane, viscoelastic polymers, or any other elastic material known in the art. In embodiments grip layer 92 may comprise of rubber, silver, aluminum, or any other high friction materials known in the art.

Longitudinal Coupling of Multiple Lanes

FIGS. 7-10 depict at least one lane 12 (e.g., lane 12A and at least one alternative lane 12B) coupled to one another lengthwise by coupling first fastening mechanism 34 to second fastening mechanism 36, according to embodiments of the present disclosure. In embodiments, first fastening mechanism 34 may be coupled to lane 12A and second fastening mechanism 36 may be coupled to at least one alternative lane 12B. As shown in FIGS. 7-10, in embodiments, first fastening mechanism 34 may extend outwardly from second end 18A of lane 12A and may engage with second fastening mechanism 36 residing at first end 16B of at least one alternative lane 12B.

Figure 7:
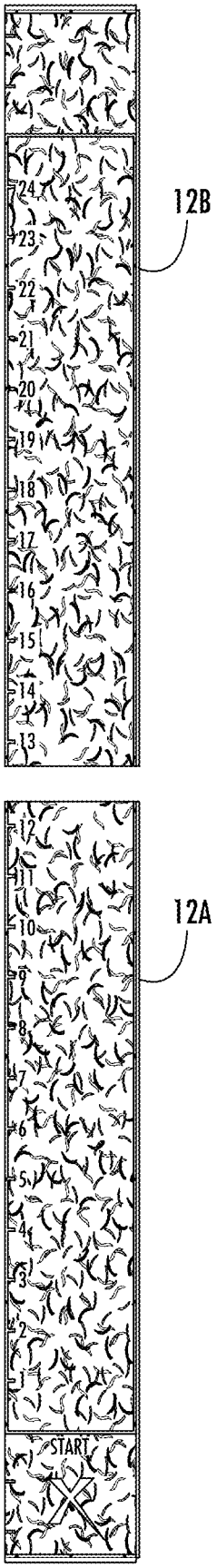
FIG. 7 is a top view of a lane and an alternative lane spaced apart from one another according to embodiments of the present disclosure.
Figure 8:
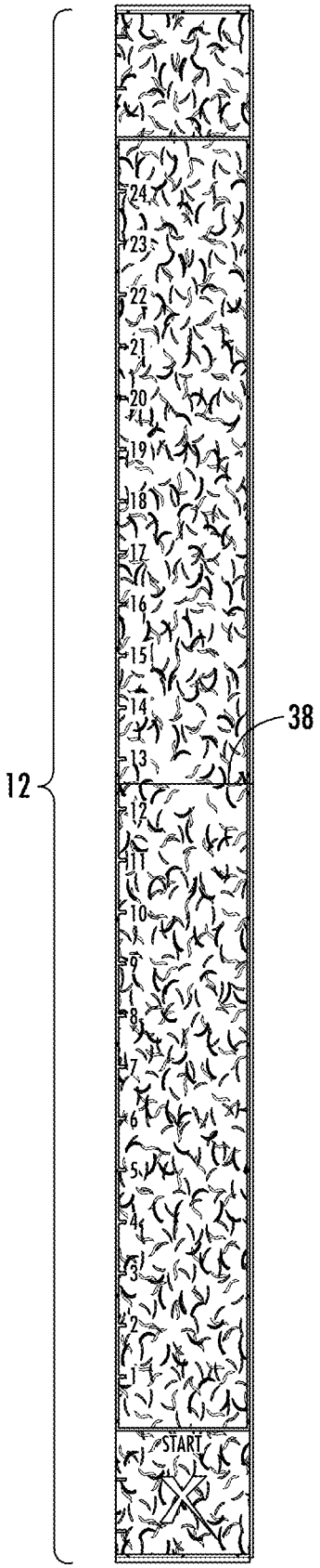
FIG. 8 is a top view of the lane and the alternative lane of FIG. 7 coupled with each other to form a longer exercise and training area according to embodiments of the present disclosure.

FIGS. 7 and 8 depict the before and after of first fastening mechanism 34 and second fastening mechanism 36 of lane 12A and at least one at least one alternative lane 12B being fully engaged, according to embodiments of the present disclosure. In embodiments, engagement of first fastening mechanism 34 with second fastening mechanism 36, such as by hook and loop or magnetic fasteners, may couple lane 12A with at least one alternative 12B forming seam 38. In other embodiments, engagement of first fastening mechanism 34 with second fastening mechanism 36 may comprise magnets, strap and clip mechanisms, ratchet mechanism, and socket fasteners, or any other fastening mechanism known in the art.

Figure 10:
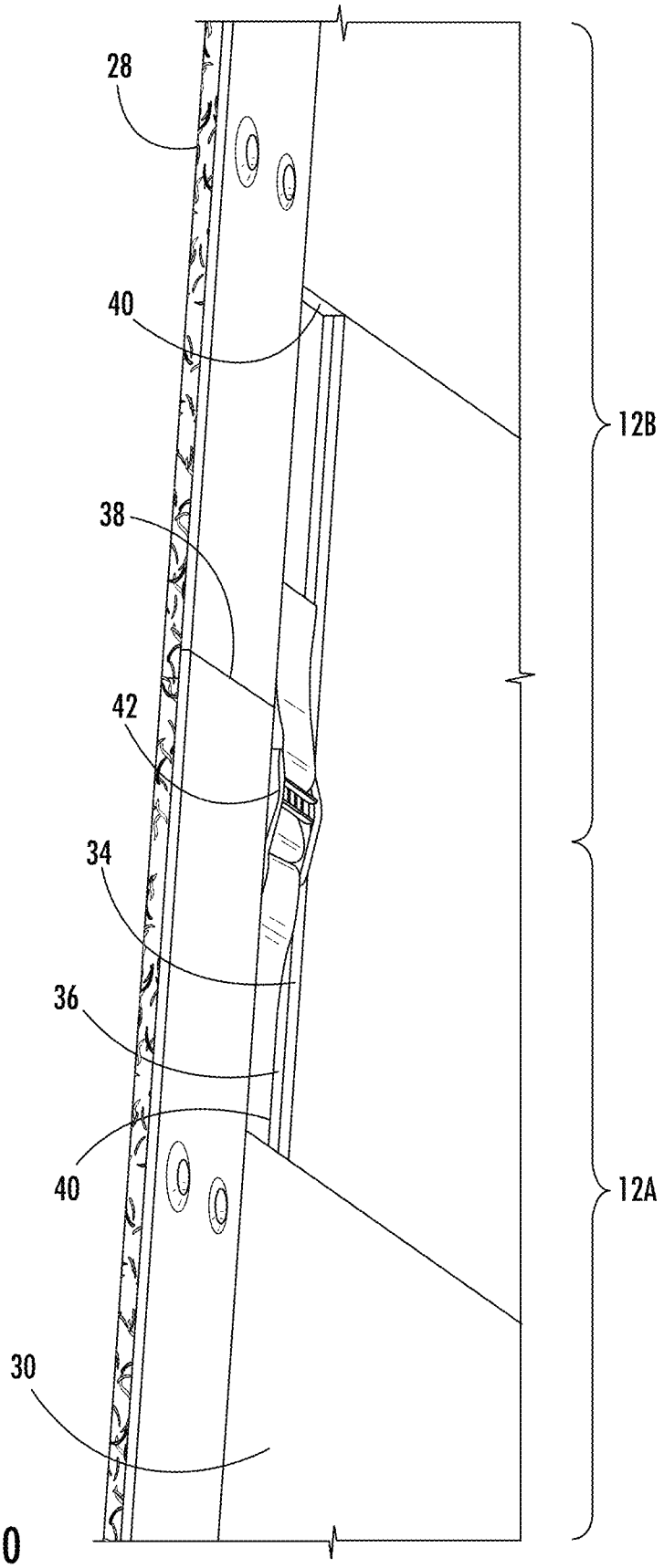
FIG. 10 is a perspective view of an underside of an embodiment of a lane and an alternative lane coupled to one another according to embodiments of the present disclosure.

As shown in FIG. 10, in embodiments, cutouts 40 may be formed within underlying substrate 30 of lane 12, in order to provide a recess for first 34 and second 36 fastening mechanisms to reside. In embodiments, cutouts 40 include a depth greater than the combined width of first 34 and second 36 fastening mechanisms. In embodiments, cutouts 40 may permit the joining of lane 12A with at least one alternative lane 12B without first 34 and second 36 fastening mechanisms creating an obstruction or trip hazard by forcing top layer 28 to bulge out of a plane.

Figure 9:
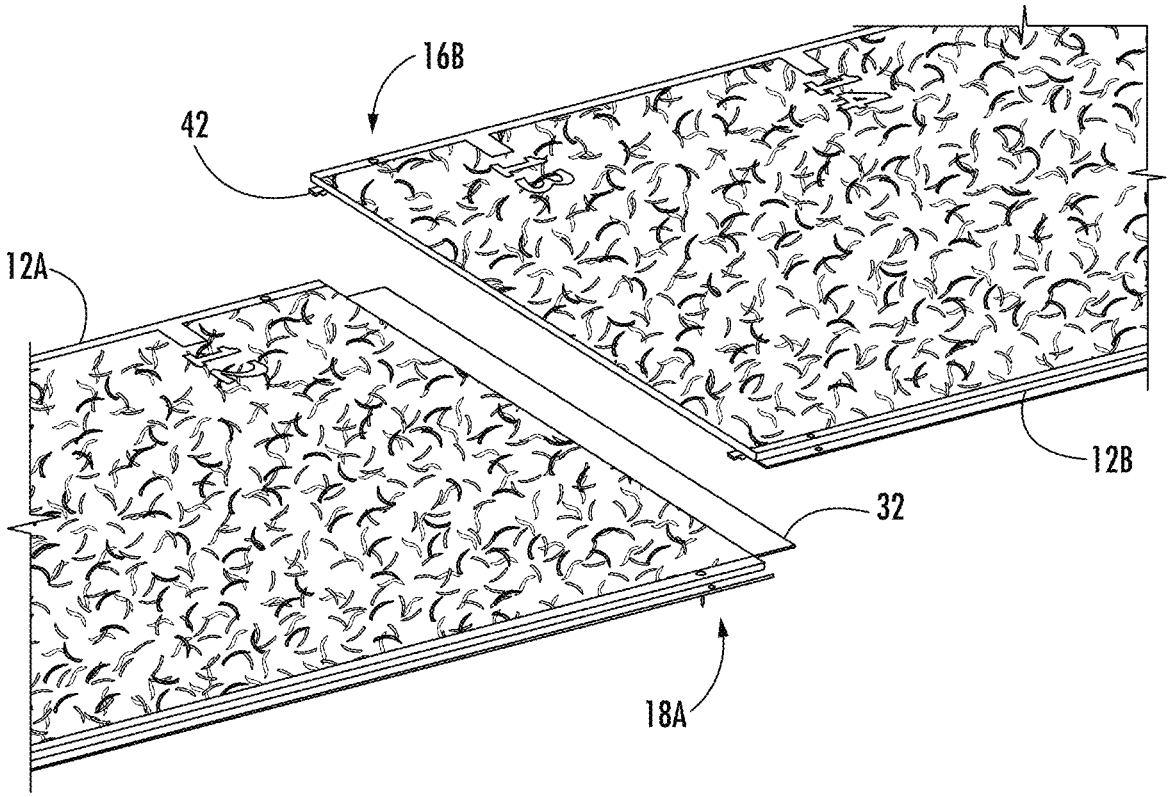
FIG. 9 is a perspective view of an embodiment of a lane and an alternative lane spaced apart from one another according to embodiments of the present disclosure.

As shown in FIGS. 9 and 10, in other embodiments, first 34 and second 36 fastening mechanisms may include a plurality of magnets. Magnets may be temporarily or permanently disposed at second end 16 or first end 18 of at least one lane 12. In other embodiments, the magnets may be any material having magnetic properties, including, but not limited to, ferromagnetic materials. In other embodiments, first 34 and second 36 fastening mechanisms may employ several magnets, with the strength of magnets varying depending on the intended use and/or intended terrain of which lanes 12 are being deployed.

As shown in FIGS. 9 and 10, in embodiments, secondary fastening mechanism 42 may be provided to cinch lane 12A to at least one alternative lane 12B together, thereby forming a tight or secure seam 38. In embodiments, secondary fastening mechanisms 42 may include a strap and clip arrangement, ratchet mechanism, socket fasteners, or any other fasteners known in the art to secure lane 12A and at least one alternative lane 12B together and prevent the premature or unintended separation during use. Moreover, in embodiments, secondary fastening mechanism 42 may be similarly disposed within cutout 40 to prevent the formation of a hump or otherwise non-planar turf layer 28.

As shown in FIGS. 7-10, first fastening mechanism 34 and secondary fastening mechanism 36 may be temporarily secured to lane 12A and/or alternative lane 12B. In some embodiments, first fastening mechanism 34 and secondary fastening mechanism 36 of lane 12A and/or alternative lane 12B, respectively, may be disposed on a body independent of lane 12A and/or alternative lane 12B. Accordingly, first fastening mechanism 34 of lane 12A and/or alternative lane 12B, respectively, may be disposed on a body independent of lane 12A and/or alternative lane 12B, while secondary fastening mechanism 36 may be disposed on lane 12A and/or alternative lane 12B.

As shown in FIGS. 1-10, the testing and training environment may comprise lane 12A and/or alternative lane 12B. In some embodiments, lane 12 may comprise half of the required length of the testing and training environment. In embodiments, the testing and training environment dimensions may be increased or decreased based on the addition or removal of alternative lane 12B to lane 12A.

Horizontal Couple of Multiple Lanes

Figure 11:
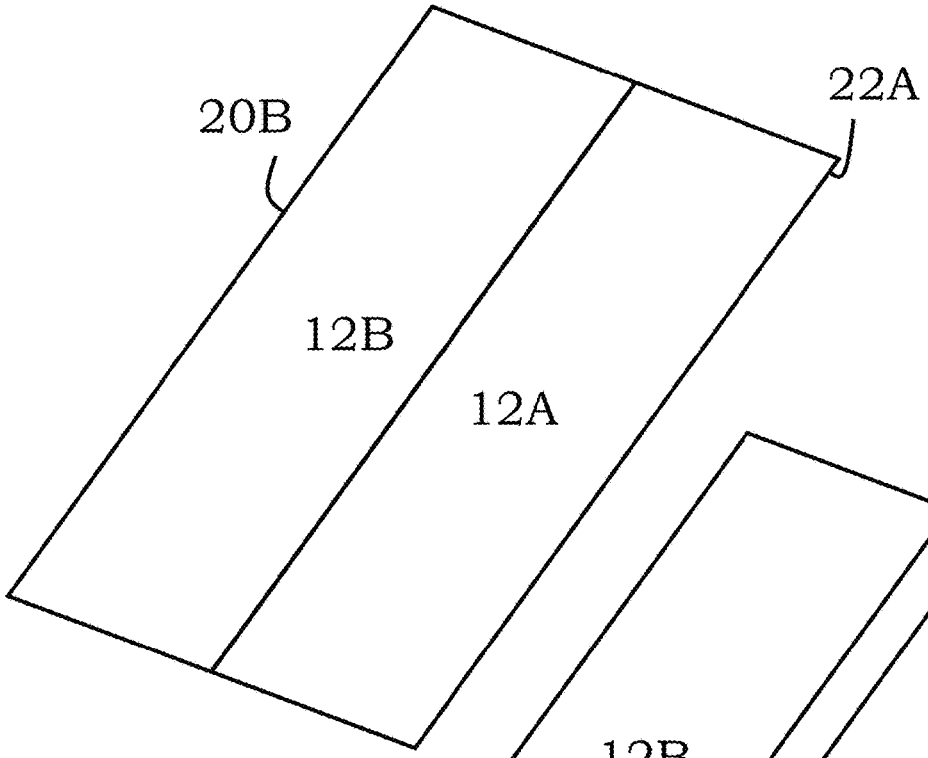
FIG. 11 is a perspective view of an embodiment of a lane and an alternative lane coupled horizontally according to embodiments of the present disclosure.
Figure 12:
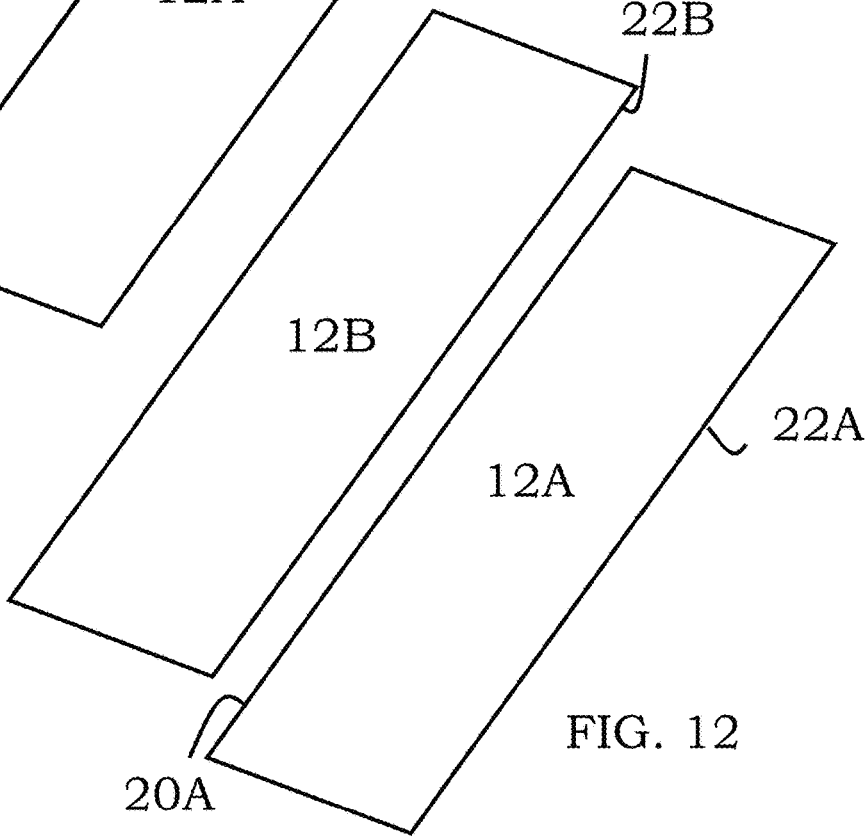
FIG. 12 is a perspective view of the lane and the alternative lane of FIG. 11 uncoupled and spaced apart from one another according to embodiments of the present disclosure.

Certain environments may necessitate a larger exercising or testing area, according to embodiments of the present disclosure. As shown in FIG. 5, in embodiments, at least one lane 12 may be coupled horizontally along lateral sides 20, 22. As shown in FIGS. 11-14, in embodiments, the horizontal coupling of lane 12A with at least one alternative lane 12B may be accomplished via magnets, hook and loop fasteners, or other fastening methods known in the art. As shown in FIGS. 11 and 12, in embodiments, first lateral side 20A of lane 12A may be configured to engage with complementary second lateral side 22B of at least one alternative lane 12B. In embodiments, second lateral side 22A of lane 12A may be configured to engage with complementary first lateral side 20B of at least one alternative lane of 12B.

Figure 13:
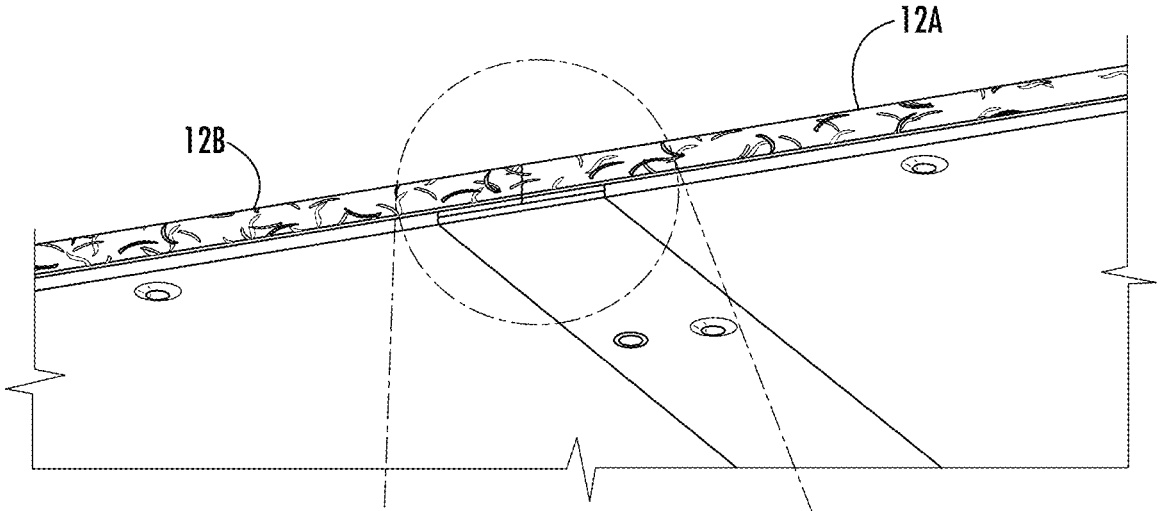
FIG. 13 is a perspective view of an underside of a lane and an alternative lane coupled together according to embodiments of the present disclosure.
Figure 14:
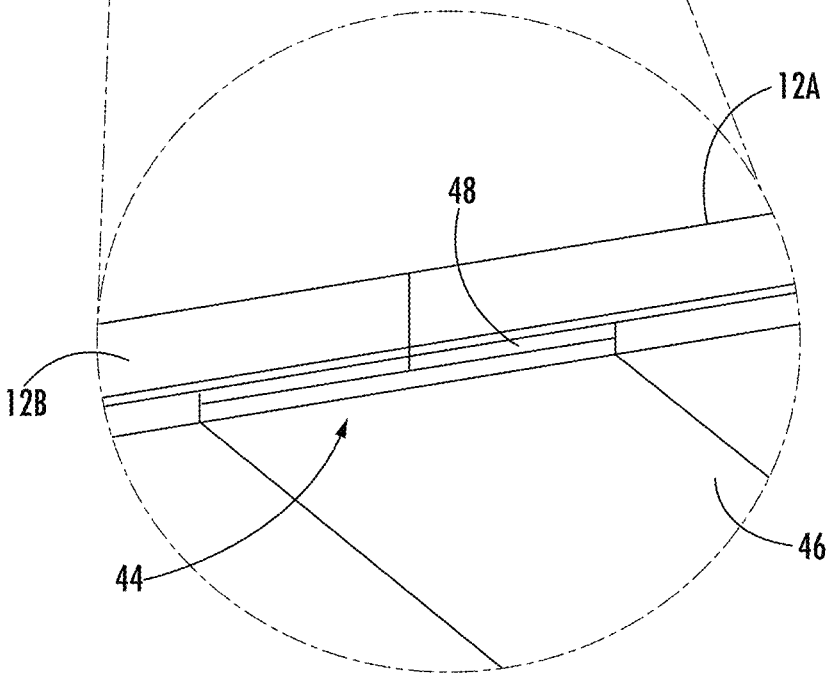
FIG. 14 is a close-up view of the seam of the lane and the alternative lane of FIG. 12.
Figure 15:
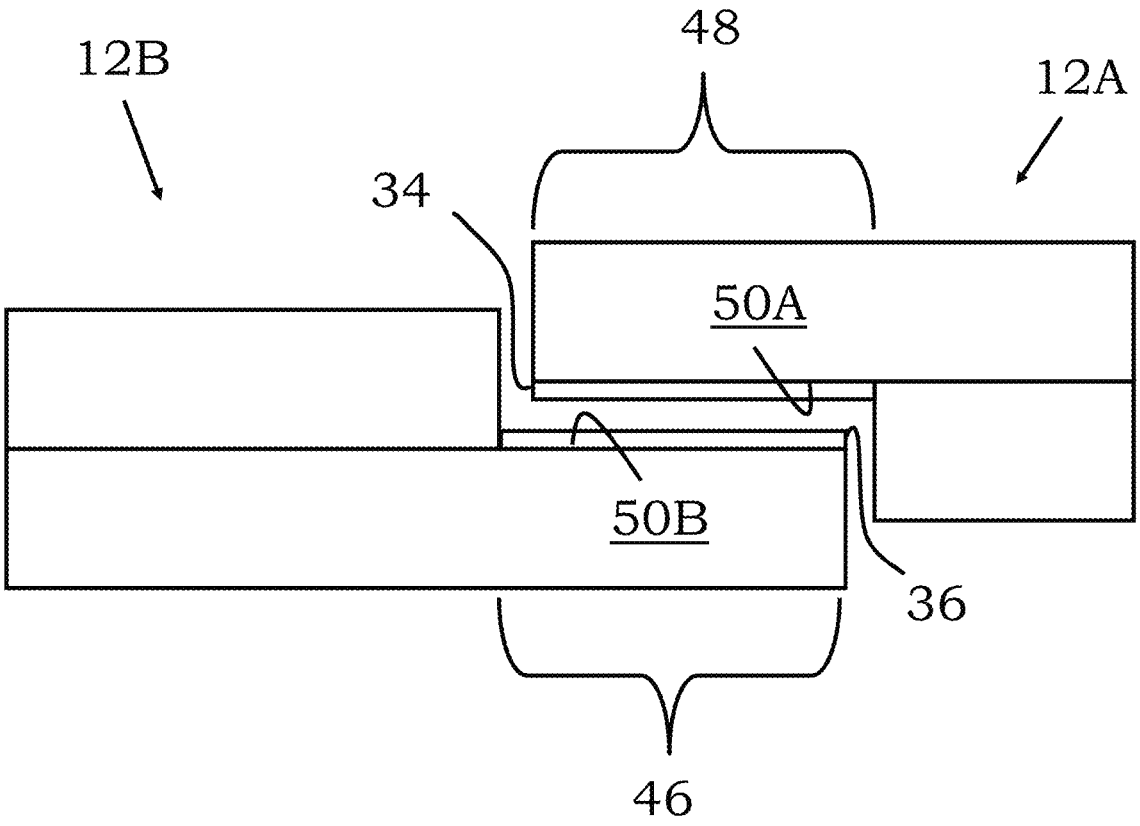
FIG. 15 is a side view of an embodiment of a lane and an alternative lane spaced apart from one another according to embodiments of the present disclosure.

FIGS. 13 and 14 depict an embodiment of lane 12A and at least one alternative lane 12B configured to couple in a lap joint arrangement 44, wherein extension 46 of complementary second lateral side 22B of at least one alternative lane 12B is configured to engage with overhang 48 of first lateral side 20A of lane 12A, according to embodiments of the present disclosure. As shown in FIG. 15, in embodiments, cheek 50A of lane 12A and 50B of at least one alternative lane 12B may include first fastening mechanism 34 and second fastening mechanism 36, respectively. In some embodiments, first 34 and second fastening mechanism 36 may comprise of hook and loop fasteners, magnets, or any fastening mechanism known in the art. As shown in FIGS. 11 and 15, in embodiments, when cheek 50A of lane 12A is be disposed adjacent to cheek 50B of at least one alternative lane 12B, first fastening mechanism 34 of lane 12A may engage with complementary second fastening mechanism 36 of at least one alternative lane 12B, thereby securing lane 12A to at least one alternative lane 12B. In some embodiments, this process can be repeated for multiple additional lanes.

As shown in FIGS. 11-14, first fastening mechanism 34 and secondary fastening mechanism 36 may be temporarily secured to lane 12A and/or alternative lane 12B. In some embodiments, first fastening mechanism 34 and secondary fastening mechanism 36 of lane 12A and/or alternative lane 12B, respectively, may be disposed on a body independent of lane 12A and/or alternative lane 12B. Accordingly, first fastening mechanism 34 of lane 12A and/or alternative lane 12B, respectively, may be disposed on a body independent of lane 12A and/or alternative lane 12B, while secondary fastening mechanism 36 may be disposed on lane 12A and/or alternative lane 12B.

Anchoring of Lane(s) to Terrain

Figure 16:
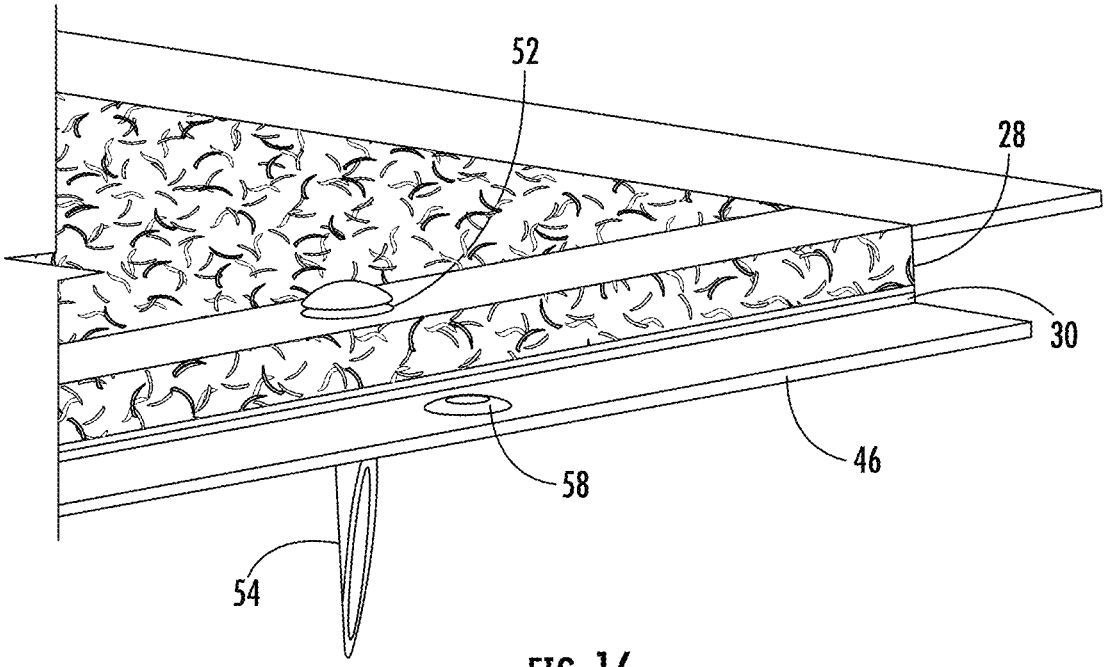
FIG. 16 is a perspective side view of an embodiment of a lane according to embodiments of the present disclosure.
Figure 17:
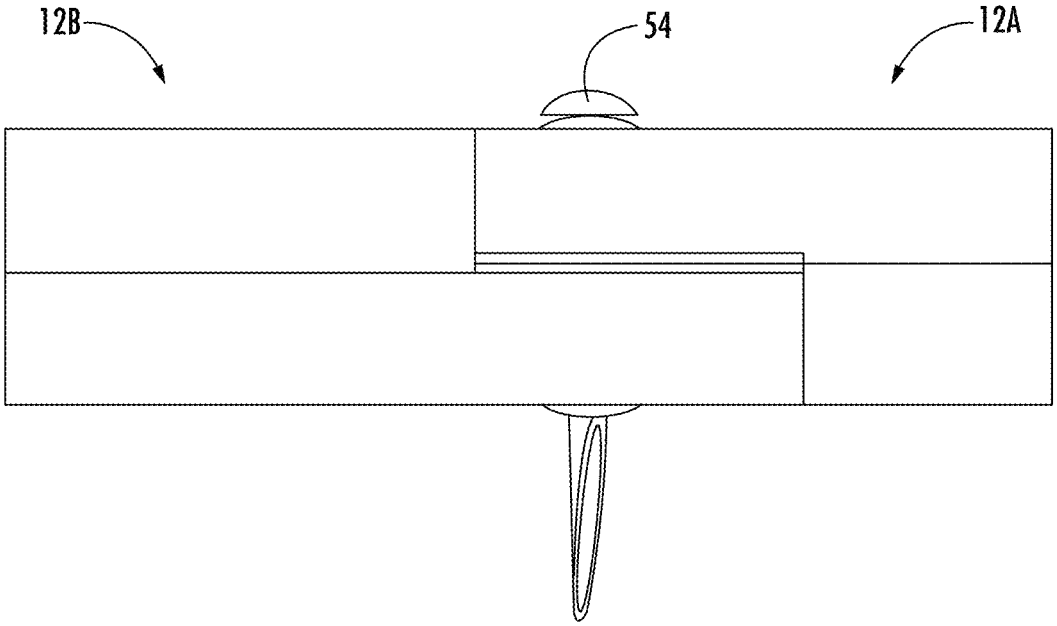
FIG. 17 is the side view of FIG. 15 in which the lane and the alternative lane are secured to one another according to embodiments of the present disclosure.

FIG. 16 depicts plurality of apertures 52 extending between turf layer 28 and underlying substrate 30 of lane 12, according to embodiments of the present disclosure. In embodiments, plurality of apertures 52 may be disposed about at least a portion of the perimeter of lane 12 and may be configured to receive plurality of anchors 54, thereby securing lane 12 to a surface. In embodiments, the surface may comprise any substantially planar area, such as field, concrete, dirt, sand, or any other surface known in the art. As shown in FIGS. 16 and 17, in embodiments, extension 46 may include one or more plurality of apertures 52, providing additional anchoring points and further securing at least one alternative lane 12B to lane 12A. In some embodiments, plurality of apertures 52 may offer anchoring points to plurality of anchors 54, including stakes, hooks, or any other anchors known in the art, and may prevent premature wear and tear on lane 12, thereby prolonging the life of lane 12.

Figure 18:
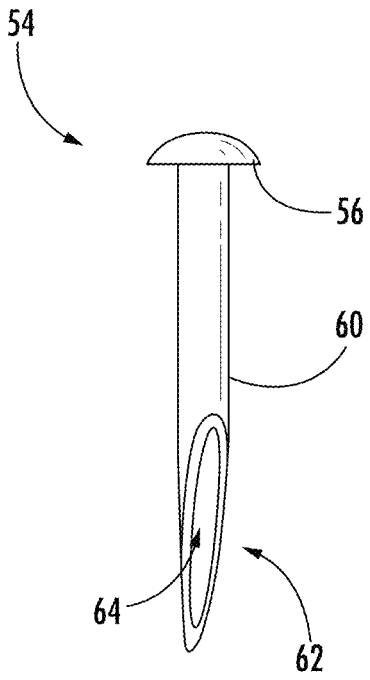
FIG. 18 is a side view of an embodiment of an anchor according to embodiments of the present disclosure.

FIGS. 16 and 18 depict plurality of anchors 54 including flange 56 configured to abut surface 58 of plurality of apertures 52, when secured therein, according to embodiments of the present disclosure. As shown in FIG. 18, in embodiments, shaft 60 may extend from flange 56 to terminal end 62 of plurality of anchors 54. In some embodiments, terminal end 62 of plurality of anchors 54 may be tapered to facilities the insertion of plurality of anchors 54 into the ground. In some embodiments, plurality of anchors 54 may include hollow core 64 extending at least partially from terminal end 62 toward flange 56. In embodiments, hollow-core 64 may permit plurality of anchors 54 to be secured effectively within a wide range of terrain.

End Caps

Figure 19:
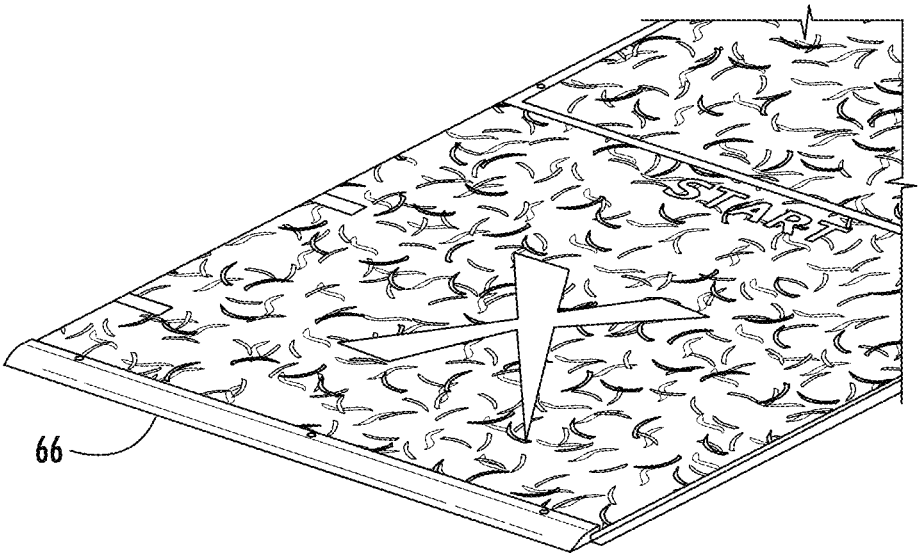
FIG. 19 is a perspective view of an embodiment of a lane showing an end cap coupled to the lane at an end according to embodiments of the present disclosure.
Figure 20:
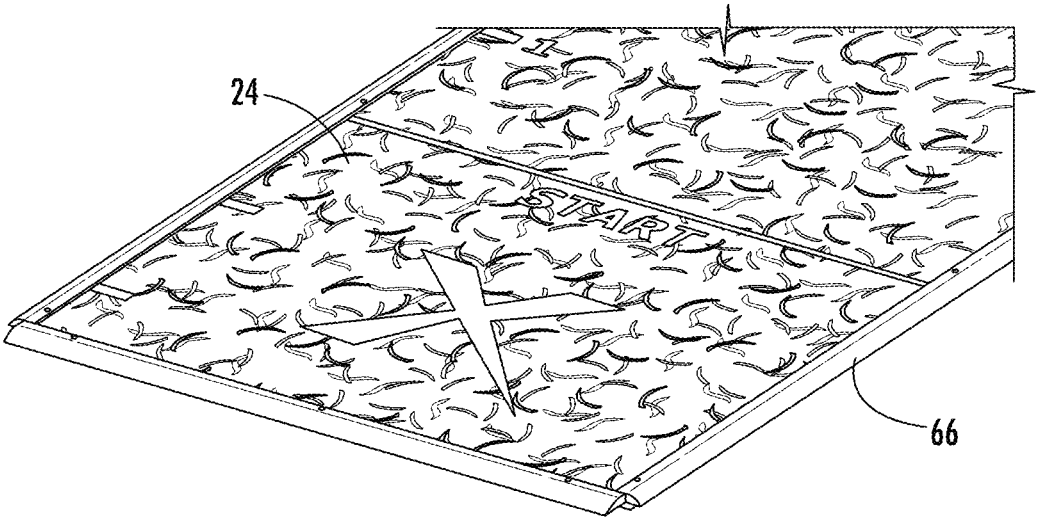
FIG. 20 is the perspective view of FIG. 19 in which a second and a third end caps are coupled to the lateral sides of the lane according to embodiments of the present disclosure.

As shown in FIGS. 5, 19 and 20, in embodiments, end caps 66 may be permanently or temporarily coupled to the perimeter edge of lane 12. In embodiments, end caps 66 may help prevent injury to the users by providing a sloped surface between the terrain and top surface 24 of lane 12. In some embodiments, end caps 66 may provide a sloped surface between the terrain and the underlying substrate 30. As shown in FIGS. 5 and 20, in embodiments, end caps 66 may be permanently or temporarily coupled to first end 16, second end 18, first lateral side 20, or second lateral side 22. In embodiments, end caps 66 may be made of metal, rubber, plastic, wood, or any other material resistant to wear, heat, and stress.

Containment Unit Component

Figure 21:
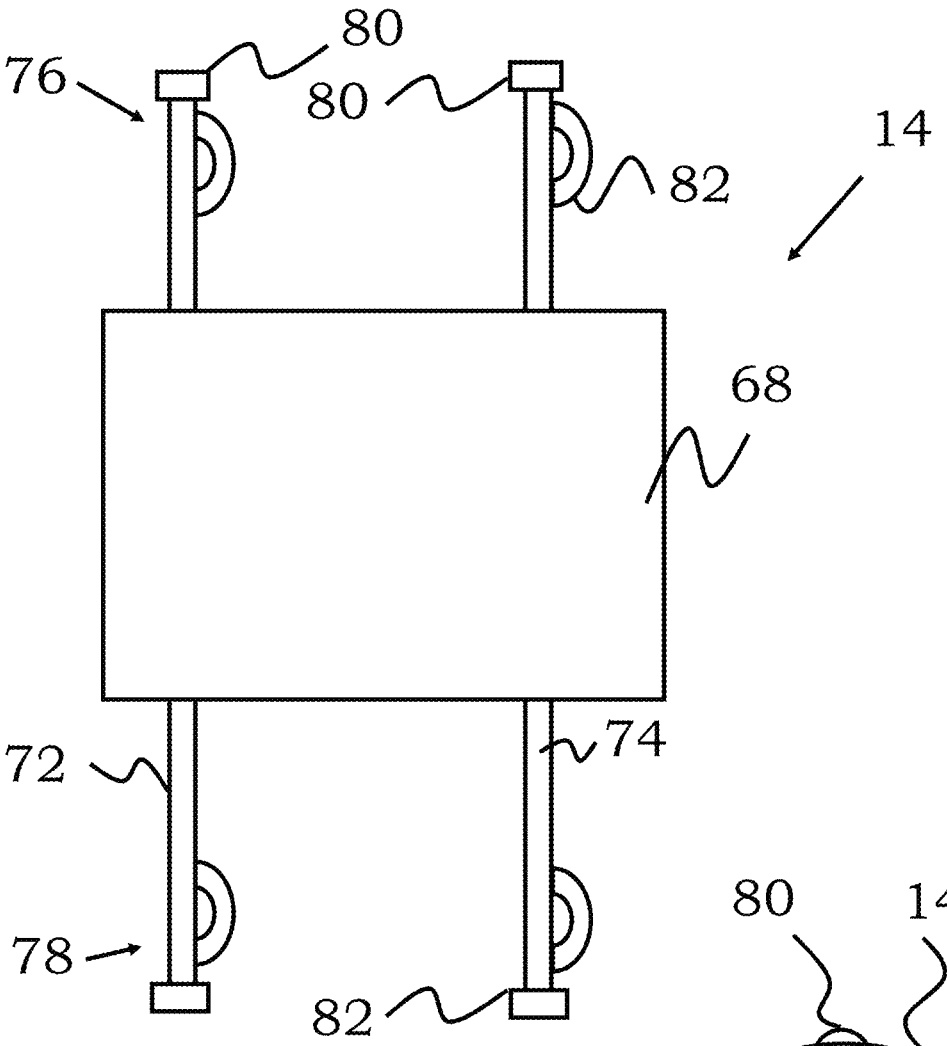
FIG. 21 is a top view of an embodiment of the containment unit in an unlocked configuration according to embodiments of the present disclosure.
Figure 22:
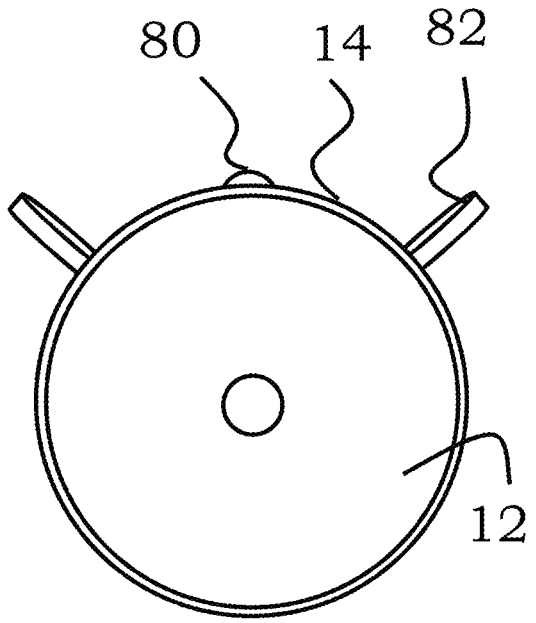
FIG. 22 is a side view of an embodiment of the containment unit in the locked configuration according to embodiments of the present disclosure.
Figure 23:
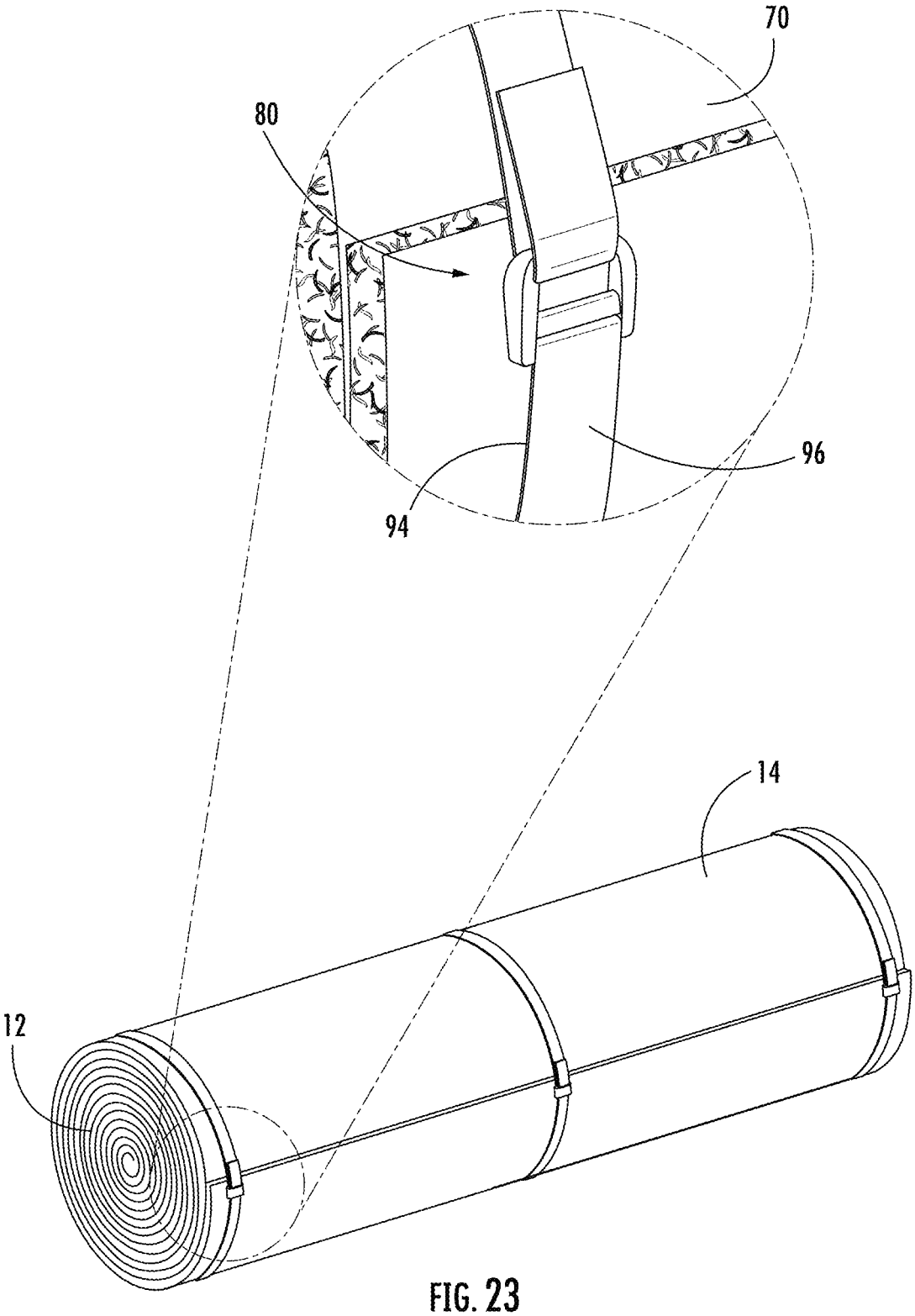
FIG. 23 is a perspective view of an embodiment of the containment unit according to embodiments of the present disclosure.

FIGS. 21-23 depict transport, protection, and storage containment unit 14, according to embodiments of the present disclosure. In embodiments, containment unit 14 may increase the lifespan of lane 12. In embodiments, containment unit 14 may provide a quick and easy way to transport and deploy lane 12. In embodiments, containment unit 14 may include an interior surface 68 opposite exterior surface 70. As shown in FIG. 21, in embodiments, at least one strap 72 may be spaced apart and disposed parallel to one another. In embodiments, at least one strap 72 may have body 74, which may extend between first end 76 and second end 78. In embodiments, at least a portion of body 74 may be coupled or integrally formed with exterior surface 70 of containment unit 14, which may temporarily or permanently secure at least one strap 72 to containment unit 14.

FIG. 23 depicts a pair of attachment components 80 that are disposed at first end 76 of at least one strap 72, according to embodiments of the present disclosure. In embodiments, when lane 12 is placed on interior surface 68 of containment unit, as shown in FIGS. 21 and 22, attachment component 80 may be brought into proximity with second end 78 of at least one strap 72. In embodiments, second end 78 of at least one strap 72 may include a complementary attachment component 80 configured to engage with the pair of first attachment components 80 on at least one strap 72. As shown in FIGS. 21 and 23, in embodiments, attachment component 80 may be configured to directly engage with second end 78 of at least one strap 72.

As shown in FIGS. 21-23, in embodiments, when first end 76 of at least one strap 72 is brought into proximity with second end 78 of at least one strap 72, containment unit 14 may be disposed around lane 12 securing lane 12, therein. FIG. 22 depicts at least one handle 82 that resides on body 74 of at least one strap 72, according to embodiments of the present disclosure. In embodiments, at least one handle 82 may provide a tacky portion of containment unit 14 for one or more users to grasp. In embodiments, by grasping at least one handle 82, the one or more users may be able to easily transport MFD 10 from one testing area to another.

As shown in FIGS. 21-23, containment unit 14 may comprise of strap 72, where strap 72 comprises an interior surface 94 and an exterior surface 96. In some embodiments, at least one strap 72 may be spaced apart and disposed parallel to another at least one strap 72. Accordingly, strap 72 may have body 74, which may extend between first end 76 and second end 78. In embodiments, when lane 12 is placed on interior surface 94 of strap 72, attachment component 80 may be brought into proximity with second end 78 of strap 72. Furthermore, second end 78 of strap 72 may include a complementary attachment component 80 configured to engage with the pair of first attachment components 80 on at least one strap 72. As shown in FIGS. 21 and 23, attachment component 80 may be configured to directly engage with second end 78 of strap 72.

As shown in FIGS. 21-23, when first end 76 of strap 72 is brought into proximity with second end 78 of strap 72, strap 72 may be disposed around lane 12, thereby securing lane 12, therein. In some embodiments, handle 82 may reside on body 74 of strap 72. Accordingly, handle 82 may provide a tacky portion of strap 72 for one or more users to grasp. In embodiments, by grasping handle 82, the one or more users may be able to easily transport MFD 10 from one testing area to another.

Figure 24:
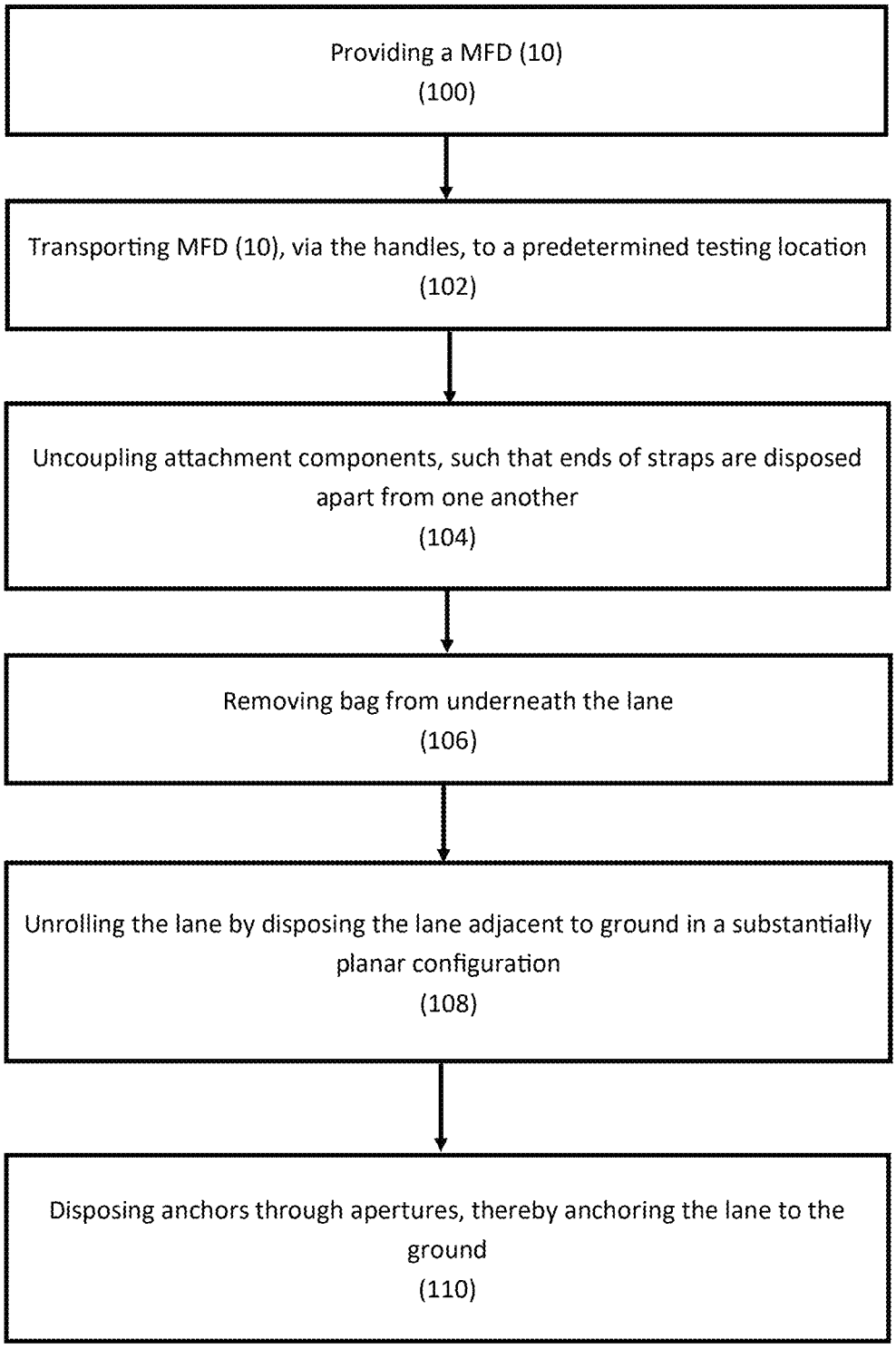
FIG. 24 is a flow chart diagram of a method for deploying the MFD according to embodiments of the present disclosure.
Figure 24:
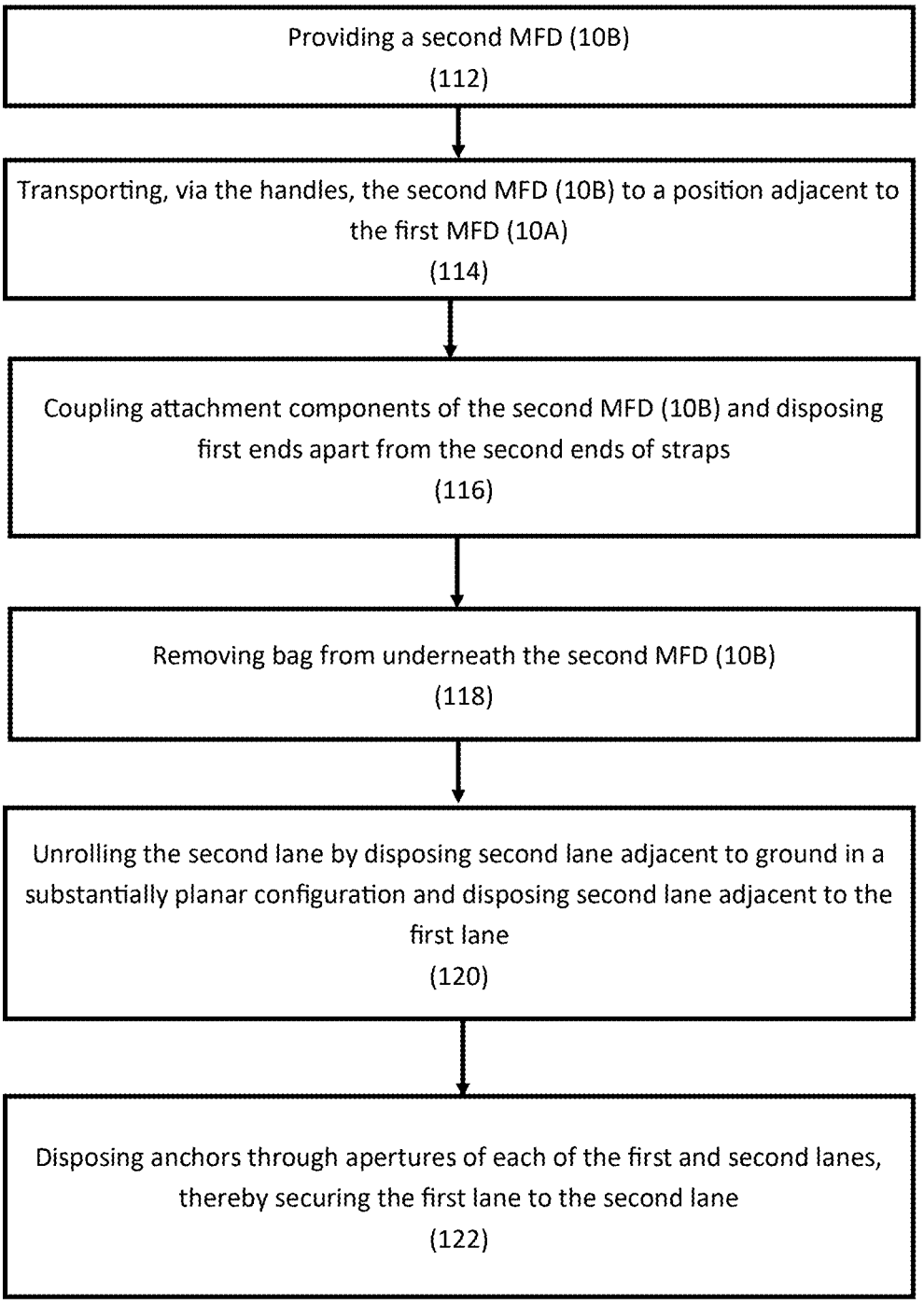

FIG. 24, in conjunction with FIGS. 1-23, depict an exemplary process flow diagram of deploying MFD 10, according to embodiments of the present disclosure. In embodiments, the steps delineated in the exemplary process flow diagram of FIG. 24 may be merely exemplary of a preferred order for the deployment of MFD 10. In embodiments, the steps may be carried out in another order, with or without additional steps included therein. Furthermore, in embodiments, the steps may be carried out with an alternative embodiment of MFD 10, as contemplated in the description above.

As shown in FIG. 24 in conjunction with FIGS. 1-23, in embodiments, the flow diagram of deploying MDF 10 may begin at step 100, during which MFD 10 may be provided. In embodiments, MFD 10 may include the components discussed above. In embodiments, the flow diagram then proceeds to step 102, in which a pair of users may grasp at least one handle 82 and may transport MFD 10 to a desired location, where MFD 10 may be disposed adjacent to the surface. In embodiments, as shown in FIG. 24 in conjunction with FIGS. 21-23, in step 104, attachment component 80 may be uncoupled, and ends 76, 78 may be disposed apart from one another, exposing lane 12 in the compact configuration. In other embodiments, the compact configuration may comprise a coiled, folded, or collapsed configuration. In embodiments, in step 106, containment unit 14 may be removed from underneath lane 12. In embodiments, users may then unfurl lane 12, such that lane 12 may be substantially planar at step 108. As shown in FIG. 24 in conjunction with FIGS. 16-18, in embodiments, plurality of anchors 54 may then be disposed through plurality of apertures 52, such that terminal end 62 is driven into the ground and flange 56 abut surface 58 of plurality of apertures 52 at step 110.

As shown in FIG. 24 in conjunction with FIGS. 1-23, in some embodiments, in step 112, at least one alternative MFD 10B may be provided, including the components discussed above. In embodiments, in step 114, at least one alternative MFD 10B may be transported by users via at least one handle 82 and disposed adjacent to first MFD 10A. In embodiments, in step 116, attachment component 80 may be uncoupled, and ends 76, 78 may be disposed apart from one another, exposing at least one alternative lane 12B in a compact configuration. In some embodiments, in step, 118, containment unit 14 may be removed from underneath at least one alternative lane 12B. In some embodiments, users may then unfurl at least one alternative lane 12B and may dispose at least one alternative lane 12B adjacent to lane 12A in step 120, such that first lateral side 20A of lane 12A couples in an overlapping relationship with second lateral side 22B of at least one alternative lane 12B. In some embodiments, in step 122, plurality of anchors 54 may be disposed through plurality of apertures 52, such that plurality of apertures 52 secure both lane 12A and at least one alternative lane 12B together.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A mobile fitness training and testing device comprising:

a lane comprising:

an elongated body extending between a first end and a second end of the lane, and a width of the lane extending between a first lateral side and a second lateral side of the lane;

a perimeter, wherein the perimeter outlines the elongated body and the width of the lane;

a turf layer, wherein the turf layer includes a height extending between a top surface and a bottom surface of the turf layer;

an underlying substrate, wherein the underlying substrate includes a height extending between a top surface and a bottom surface of the underlying substrate;

wherein the bottom surface of the turf layer is adhered to the top surface of the underlying substrate;

a plurality of apertures disposed about at least a portion of the perimeter, wherein the plurality of apertures extends from the top surface of the turf layer through the bottom surface of the underlying substrate;

a plurality of anchors, wherein the plurality of anchors is operably engaged to the plurality of apertures;

wherein the lane is configured to interconnect to at least one alternative lane;

wherein the lane includes at least two configurations, including an extended configuration and a compact configuration;

wherein the extended configuration comprises the lane unfurled and disposed adjacent to a surface in a planar configuration;

wherein the compact configuration comprises the lane adapted to fit within a containment unit, and wherein the compact configuration has a total weight of substantially at least 275 pounds and substantially at most 500 pounds;

the containment unit comprising:

a body having an interior surface opposite an exterior surface, wherein the interior surface of the body is configured to abut at least a portion of the lane, when the lane is encapsulated within the containment unit;

a strap, wherein the strap is coupled to at least a portion of the exterior surface of the body;

wherein the strap has a body extending between a first end and a second end of the strap; and a handle disposed on a portion of the body of the strap.

2. The mobile fitness training and testing device of claim 1, wherein the turf layer further comprises a plurality of fibers and a backing material, wherein the plurality of fibers is attached to the backing material.

3. The mobile fitness training and testing device of claim 1, wherein the underlying substrate further comprises two layers, a shock-absorbent layer and a grip layer, respectively.

4. The mobile fitness training and testing device of claim 1, wherein the compact configuration further comprises a coiled configuration, a folded configuration, and a collapsed configuration.

5. The mobile fitness training and testing device of claim 1, wherein the elongated body of the lane comprises a distance of at least 10 meters to at most 30 meters.

6. The mobile fitness training and testing device of claim 5, wherein the width of the lane comprises a distance of at least 0.5 meters to at most 5 meters.

7. The mobile fitness training and testing device of claim 6, wherein the height of the turf layer comprises a range of at least 0.1 inches and at most 4 inches.

8. The mobile fitness training and testing device of claim 7, wherein the height of the underlying substrate comprises a range of at least 0.1 inches and at most 2 inches.

9. The mobile fitness training and testing device of claim 1, wherein the turf layer further comprises labeled calibrated distance markings along at least one of the lateral sides of the lane.

10. The mobile fitness training and testing device of claim 9, wherein the turf layer further comprises a line marking along at least one of the ends of the lane.

11. The mobile fitness training and testing device of claim 1, wherein the lane is configured to interconnect to the at least one alternative lane through a fastening mechanism.

12. The mobile fitness training and testing device of claim 1, wherein the first end and the second end of the strap includes an attachment component.

13. The mobile fitness training and testing device of claim 12, wherein the attachment component is configured to engage the first end and the second end of the strap thereby securing the interior surface of the body of the containment unit around the lane.

14. The mobile fitness training and testing device of claim 1, wherein at least the first end, the second end, the first lateral side, or the second lateral side of the lane, or the second lateral side is coupled with an end cap.

15. The mobile fitness training and testing device of claim 14, wherein the end cap comprises a gradually sloped body spaced between the surface and the lane.

16. A mobile fitness training and testing system comprising:

a lane comprising:

an elongated body extending between a first end and a second end of the lane, and a width of the lane extending between a first lateral side and a second lateral side of the lane;

wherein the elongated body comprises a distance of at least 10 meters to at most 30 meters;

wherein the width comprises a distance of at least 0.5 meters to at most 5 meters;

a perimeter, wherein the perimeter outlines the elongated body and the width of the lane;

a turf layer, wherein the turf layer includes a height extending between a top surface and a bottom surface of the turf layer;

wherein the height of the turf layer comprises a range of at least 0.1 inches and at most 4 inches;

an underlying substrate, wherein the underlying substrate includes a height extending between a top surface and a bottom surface of the underlying substrate;

wherein the height of the underlying substrate comprises a range of at least 0.1 inches and at most 2 inches;

wherein the bottom surface of the turf layer is adhered to the top surface of the underlying substrate;

a plurality of apertures disposed about at least a portion of the perimeter;

a containment unit comprising:

a body having an interior surface opposite an exterior surface, wherein the interior surface of the body is configured to abut at least a portion of the lane, when the lane is encapsulated within the containment unit;

a strap, wherein the strap is coupled to at least a portion of the exterior surface of the body;

wherein the strap has a body extending between a first end and a second end of the strap;

a handle disposed on a portion of the body of the strap; and wherein the lane enclosed within the containment unit has a total weight of substantially at least 275 pounds and substantially at most 500 pounds.

17. A method of training using a mobile fitness training and testing device, comprising:

transporting a lane to a predetermined testing location, the lane comprising:

an elongated body extending between a first end and a second end of the lane, and a width of the lane extending between a first lateral side and a second lateral side of the lane;

a perimeter, wherein the perimeter outlines the elongated body and the width of the lane;

a turf layer, wherein the turf layer includes a top surface and a bottom surface;

an underlying substrate, wherein the underlying substrate includes a top surface and a bottom surface;

wherein the bottom surface of the turf layer is adhered to the top surface of the underlying substrate;

a plurality of apertures disposed about at least a portion of the perimeter, wherein the plurality of apertures extends from the top surface of the turf layer through the bottom surface of the underlying substrate;

a plurality of anchors, wherein the plurality of anchors is operably engaged with the plurality of apertures;

wherein the lane is configured to interconnect to at least one alternative lane;

wherein a compact configuration of the lane comprises the lane adapted to fit within a containment unit, and wherein the compact configuration has a total weight of substantially at least 275 pounds and substantially at most 500 pounds;

removing the lane from the containment unit, the containment unit comprising:

a body having an interior surface opposite an exterior surface, the interior surface of the body configured to abut at least a portion of the lane, when the lane is positioned within the containment unit;

a strap, wherein the strap is coupled to at least a portion of the exterior surface of the body;

a first end and a second end of the strap;

a handle disposed on a portion of the body of the strap;

unfurling and disposing the lane adjacent to a surface in a substantially planar configuration;

anchoring the lane to the surface adjacent to the lane through the plurality of anchors, wherein the plurality of anchors is operably engaged to the plurality of apertures disposed about the perimeter of the lane; and performing activities upon the lane, wherein at least one user can exercise and execute tasks.

18. The method of claim 17, wherein the first end and the second end of the strap includes an attachment component.

19. The method of claim 18, wherein the attachment component is configured to engage the first end and the second end of the strap thereby securing the interior surface of the body around the lane.

20. The method of claim 17, wherein the lane is adapted to fit within the containment unit through techniques comprising coiling, folding, and collapsing.

* * * * *